US007309255B2

(12) United States Patent
Rodrigues

(10) Patent No.: US 7,309,255 B2
(45) Date of Patent: Dec. 18, 2007

(54) COAXIAL CONNECTOR WITH A CABLE GRIPPING FEATURE

(75) Inventor: Julio F. Rodrigues, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/371,513

(22) Filed: Mar. 9, 2006

(65) Prior Publication Data

US 2006/0205272 A1 Sep. 14, 2006

Related U.S. Application Data

(60) Provisional application No. 60/660,653, filed on Mar. 11, 2005.

(51) Int. Cl.
*H01R 9/05* (2006.01)

(52) U.S. Cl. ..... 439/578; 439/321

(58) Field of Classification Search ..... 439/63, 439/857, 320, 321, 578, 583
See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,544,654 | A | 3/1951 | Brown |
| 2,549,647 | A | 4/1951 | Turenne |
| 3,076,168 | A | 1/1963 | Keen |
| 3,184,706 | A | 5/1965 | Atkins |
| 3,275,913 | A | 9/1966 | Blanchard et al. |
| 3,292,136 | A | 12/1966 | Somerset |
| 3,350,677 | A | 10/1967 | Daum |
| 3,355,698 | A | 11/1967 | Keller |
| 3,373,243 | A | 3/1968 | Janowiak et al. |
| 3,406,373 | A | 10/1968 | Forney, Jr. |
| 3,448,430 | A | 6/1969 | Kelly |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |

(Continued)

FOREIGN PATENT DOCUMENTS

| | | |
|---|---|---|
| DE | 47931 | 10/1888 |

(Continued)

OTHER PUBLICATIONS

Sell Sheet from Stirling; www.StirlingUSA.com; Reader Service No. 109regarding SPL-6-RTQ 3-In-One RTQ Connectors.

(Continued)

*Primary Examiner*—Khiem Nguyen
(74) *Attorney, Agent, or Firm*—Hoffmann & Baron, LLP

(57) ABSTRACT

A coaxial cable connector including a connector body having a rearward sleeve receiving end and an inner engagement surface and an axially movable locking sleeve seated in the rearward sleeve receiving end of the connector body is disclosed. The locking sleeve has a rearward cable receiving end and an opposite forward connector insertion end. The forward connector insertion end is formed with at least one flexible finger for gripping a cable inserted in the sleeve when the locking sleeve is moved from a first position to a second position.

13 Claims, 7 Drawing Sheets

U.S. PATENT DOCUMENTS

| | | | |
|---|---|---|---|
| 3,564,487 | A | 2/1971 | Upstone et al. |
| 3,629,792 | A | 12/1971 | Dorrell |
| 3,633,150 | A | 1/1972 | Swartz |
| 3,668,612 | A | 6/1972 | Nepovim |
| 3,671,922 | A | 6/1972 | Zerlin et al. |
| 3,694,792 | A | 9/1972 | Wallo |
| 3,710,005 | A | 1/1973 | French |
| 3,778,535 | A | 12/1973 | Forney, Jr. |
| 3,781,762 | A | 12/1973 | Quackenbush |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,963,320 | A | 6/1976 | Spinner |
| 3,976,352 | A | 8/1976 | Spinner |
| 3,980,805 | A | 9/1976 | Lipari |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,554 | A | 8/1979 | Faget |
| 4,168,921 | A | 9/1979 | Blanchard |
| 4,225,162 | A | 9/1980 | Dola |
| 4,227,765 | A | 10/1980 | Neumann et al. |
| 4,250,348 | A | 2/1981 | Kitagawa |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward et al. |
| 4,408,821 | A | 10/1983 | Forney, Jr. |
| 4,408,822 | A | 10/1983 | Nikitas |
| 4,421,377 | A | 12/1983 | Spinner |
| 4,444,453 | A | 4/1984 | Kirby et al. |
| 4,456,323 | A | 6/1984 | Pitcher et al. |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,637 | A | 10/1985 | Bosshard et al. |
| 4,575,274 | A | 3/1986 | Hayward et al. |
| 4,583,811 | A | 4/1986 | McMills |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,666,229 | A | 5/1987 | Grand |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,717,355 | A | 1/1988 | Mattis |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,761,146 | A | 8/1988 | Sohoel |
| 4,772,222 | A | 9/1988 | Laudig et al. |
| 4,789,355 | A | 12/1988 | Lee |
| 4,806,116 | A | 2/1989 | Ackerman |
| 4,813,886 | A | 3/1989 | Roos et al. |
| 4,834,675 | A | 5/1989 | Samchisen |
| 4,854,893 | A | 8/1989 | Morris |
| 4,857,014 | A | 8/1989 | Alf et al. |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,007,861 | A | 4/1991 | Stirling |
| 5,021,010 | A | 6/1991 | Wright |
| 5,024,606 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver, Jr. et al. |
| 5,073,129 | A | 12/1991 | Szegda |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,141,451 | A | 8/1992 | Down |
| 5,161,993 | A | 11/1992 | Leibfried, Jr. |
| 5,181,161 | A | 1/1993 | Hirose et al. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Leibfried, Jr. |
| 5,283,853 | A | 2/1994 | Szegda |
| 5,284,449 | A | 2/1994 | Vaccaro |
| 5,295,864 | A | 3/1994 | Birch et al. |
| 5,316,494 | A | 5/1994 | Flanagan et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,435,745 | A | 7/1995 | Booth |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,494,454 | A | 2/1996 | Johnsen |

| | | | |
|---|---|---|---|
| 5,501,616 | A | 3/1996 | Holliday |
| 5,525,076 | A | 6/1996 | Down |
| 5,542,861 | A | 8/1996 | Anhalt et al. |
| 5,548,088 | A | 8/1996 | Gray et al. |
| 5,571,028 | A | 11/1996 | Szegda |
| 5,586,910 | A | 12/1996 | Del Negro et al. |
| 5,598,132 | A | 1/1997 | Stabile |
| 5,607,325 | A | 3/1997 | Toma |
| 5,620,339 | A | 4/1997 | Gray et al. |
| 5,632,651 | A | 5/1997 | Szegda |
| 5,651,699 | A | 7/1997 | Holliday |
| 5,667,405 | A | 9/1997 | Holliday |
| 5,863,220 | A | 1/1999 | Holliday |
| 5,879,191 | A | 3/1999 | Burris |
| 5,967,852 | A | 10/1999 | Follingstad et al. |
| 5,975,951 | A | 11/1999 | Burris et al. |
| 5,997,350 | A | 12/1999 | Burris et al. |
| 6,032,358 | A | 3/2000 | Wild |
| 6,089,913 | A | 7/2000 | Holliday |
| 6,146,197 | A | 11/2000 | Holliday et al. |
| 6,217,383 | B1 | 4/2001 | Holland |
| 6,241,553 | B1 | 6/2001 | Hsia |
| 6,261,126 | B1 | 7/2001 | Stirling |
| D458,904 | S | 6/2002 | Montera |
| D460,739 | S | 7/2002 | Fox |
| D460,740 | S | 7/2002 | Montera |
| D460,946 | S | 7/2002 | Montera |
| D460,947 | S | 7/2002 | Montena |
| D460,948 | S | 7/2002 | Montena |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| D468,696 | S | 1/2003 | Montena |
| 6,530,807 | B2 | 3/2003 | Rodrigues et al. |
| 6,558,194 | B2 | 5/2003 | Montena |
| 6,805,584 | B1 | 10/2004 | Chen |
| 6,817,896 | B2 | 11/2004 | Deventhal |
| 6,848,940 | B2 | 2/2005 | Montena |
| 6,976,872 | B1 | 12/2005 | Wild et al. |
| 7,008,263 | B2 | 3/2006 | Holland |
| 7,189,113 | B2 | 3/2007 | Sattele et al. |
| 2004/0102089 | A1 | 5/2004 | Chee |

FOREIGN PATENT DOCUMENTS

| | | |
|---|---|---|
| DE | 102289 | 7/1897 |
| DE | 1117687 | 11/1961 |
| DE | 1 515 398 | 11/1962 |
| DE | 1 191 880 | 4/1965 |
| DE | 2 221 936 | 5/1972 |
| DE | 2 225 764 | 5/1972 |
| DE | 2 261 973 | 12/1972 |
| DE | 32 11 008 A1 | 10/1983 |
| EP | 0 072 104 B1 | 2/1983 |
| EP | 0 116 157 A1 | 8/1984 |
| EP | 0 167 738 A2 | 1/1986 |
| EP | 0 265 276 B1 | 4/1988 |
| FR | 2 232 846 | 6/1973 |
| FR | 2 234 680 | 6/1974 |
| FR | 2 462 798 | 2/1981 |
| GB | 589697 | 3/1945 |
| GB | 1087228 | 10/1967 |
| GB | 1 270 846 | 4/1972 |
| GB | 2019 665 A | 10/1979 |
| GB | 2 079 549 A | 1/1982 |
| GB | 2079 549 A | 1/1982 |
| WO | 93/24973 | 12/1993 |
| WO | 96/08854 | 3/1996 |
| WO | WO 01/86756 | 11/2001 |

OTHER PUBLICATIONS

Sell Sheet from PCT International; Reader Service No. 133; regarding DRS Compression Connectors—description/features and benefits.

COAXIAL CONNECTOR WITH A CABLE GRIPPING FEATURE

CROSS-REFERENCE TO RELATED APPLICATIONS

This application claims the benefit of U.S. Provisional Application No. 60/660,653, filed on Mar. 11, 2005.

BACKGROUND OF THE INVENTION

The present invention relates generally to connectors for terminating coaxial cable and more particularly to a coaxial cable connector having a cable gripping feature.

It has long been known to use connectors to terminate coaxial cable so as to connect a cable to various electronic devices such as televisions, radios and the like. Prior art coaxial connectors generally include a connector body having an annular collar for accommodating a coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator. Upon assembly to a coaxial cable, the annular post is inserted between the foil covered insulator and the conductive shield of the cable.

A problem with current coaxial connectors is that they often do not adequately grip the coaxial shielded cables, particularly with smaller diameter coaxial cables. In particular, current coaxial cable connectors often rely on the post barb as the principal means for providing cable retention. This requires pushing the cable braid and jacket over the barb, thereby expanding the braid and jacket. Such expansion requires increased cable insertion force, making installation more difficult. Moreover, sealing the interior of the connector from outside elements also becomes more challenging with smaller diameter cables.

Accordingly, it would be desirable to provide a coaxial cable connector with structural features to enhance gripping, thereby facilitating cable insertion particularly with smaller diameter cables.

OBJECTS AND SUMMARY OF THE INVENTION

It is an object of the present invention to provide a coaxial cable connector for terminating a coaxial cable.

It is a further object of the present invention to provide a coaxial cable having structure to enhance gripping of a coaxial cable, especially a small diameter coaxial cable.

In the efficient attainment of these and other objects, the present invention provides a coaxial cable connector. The connector of the present invention generally includes a connector body having a rearward sleeve receiving end and an inner engagement surface and an axially movable locking sleeve seated in the rearward sleeve receiving end of the connector body. The locking sleeve has a rearward cable receiving end and an opposite forward connector insertion end. The forward connector insertion end is formed with at least one flexible finger for gripping a cable inserted in the sleeve when the locking sleeve is moved from a first position to a second position.

In a preferred embodiment, the connector body includes an internal ramp portion formed on the inner engagement surface for deflecting the flexible finger radially inward as the locking sleeve is moved from the first position to the second position. The flexible finger also preferably includes a tapered forward end defining a sharp edge to facilitate gripping of the cable.

The connector may further include an annular post disposed within the connector body and a nut rotatably coupled to the post. The sleeve and/or the connector body can be made from a plastic material and preferably include cooperating engagement surfaces to permit the axial movement of the sleeve from the first position, wherein a cable is loosely retained in the connector, to the second position, wherein a cable is secured in the connector.

The locking sleeve preferably includes a plurality of flexible fingers defining the forward connector insertion end of the sleeve. In this manner, at least two adjacent fingers of the sleeve can be connected by a web to increase gripping strength. Also, the flexible finger can include a lateral groove formed therein to enhance flexibility of the finger.

The present invention further involves a method for terminating a coaxial cable in a connector. The method includes the steps of inserting an end of a cable into a rearward cable receiving end of a locking sleeve and axially moving the locking sleeve with respect to a connector body from a first position, wherein a cable is loosely retained in the connector, to a second position, wherein a cable is secured in the connector. The axial movement of the sleeve causes a flexible finger provided on the sleeve to deflect radially inward to grip the end of the cable. In this regard, the flexible finger can be made to engage an internal ramp portion of the connector body, which deflects the finger radially inward as the locking sleeve is moved from the first position to the second position.

To further enhance gripping of the cable, the annular post disposed within the connector body preferably includes a first radially outwardly projecting barb disposed at a rearward end thereof and a second radially outwardly projecting barb disposed forward of the first barb. More specifically, the post may include a shoulder portion in press-fit engagement with the connector body and an annular tubular extension extending between the shoulder portion and the first and second barbs and having a maximum outer diameter. The first and second barbs thus have an outer diameter greater than the maximum outer diameter of the annular tubular extension.

The gripping action of the fingers increases cable retention. This allows reducing the diameter of the barb on the post which facilitates cable insertion. Therefore, the present invention allows a user to insert a coaxial shielded cable into the coaxial connector with less force than current connectors to prevent buckling of the coaxial shielded cable. The present invention also allows for the coaxial shielded cable to be held securely within the coaxial connector without buckling the coaxial shielded cable.

For a better understanding of the present invention, reference is made to the following description to be taken in conjunction with the accompanying drawings and its scope will be pointed out in the appended claims.

DETAILED DESCRIPTION OF THE PREFERRED EMBODIMENTS

Figure 1:
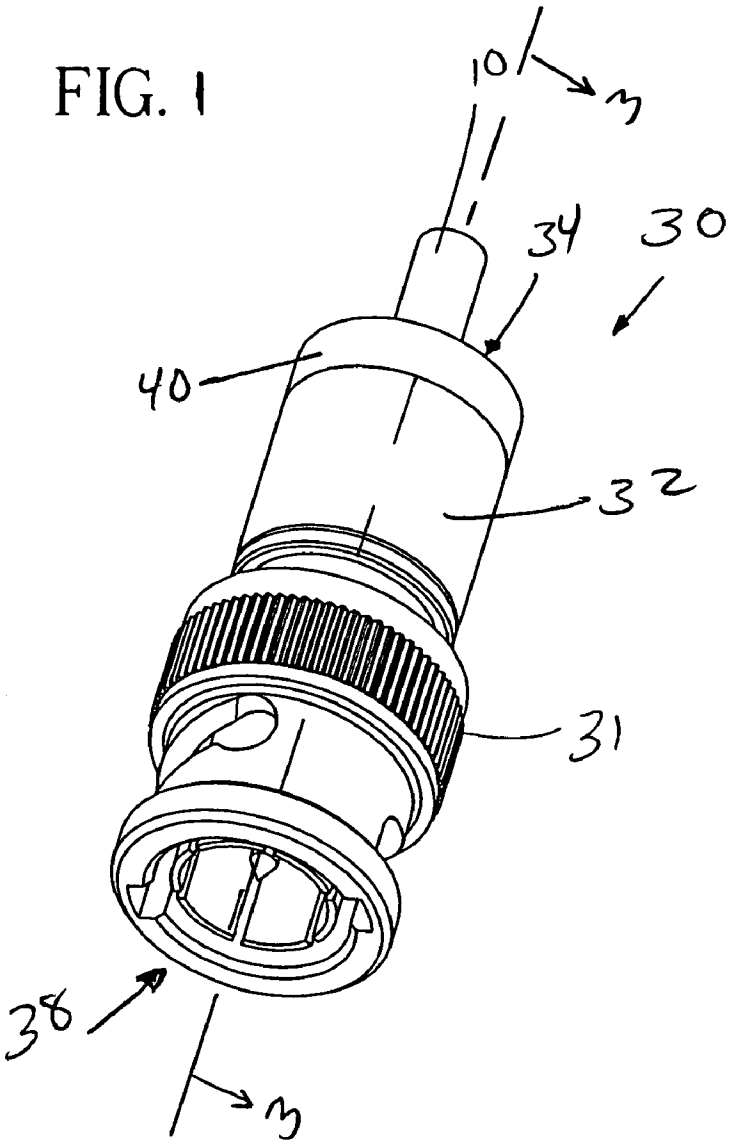
FIG. 1 is a perspective view of the coaxial cable connector of the present invention fully assembled.

Referring to FIG. 1, a coaxial connector 30 in accordance with the present invention is shown. The connector 30 has a housing 32 (sometimes referred to as a "connector body" or "collar") having a first end 34 and a sleeve 40 which accepts a coaxial shielded cable 10. Positioned opposite the first end 34 is a second end 38 having a twistlock device 31 used to attach the connector 30 to the desired mating device (not shown). The connector 30 is shown fully assembled and is a compact design. The housing 32, and sleeve 40 can have a cylindrical outer profile.

Figure 3:
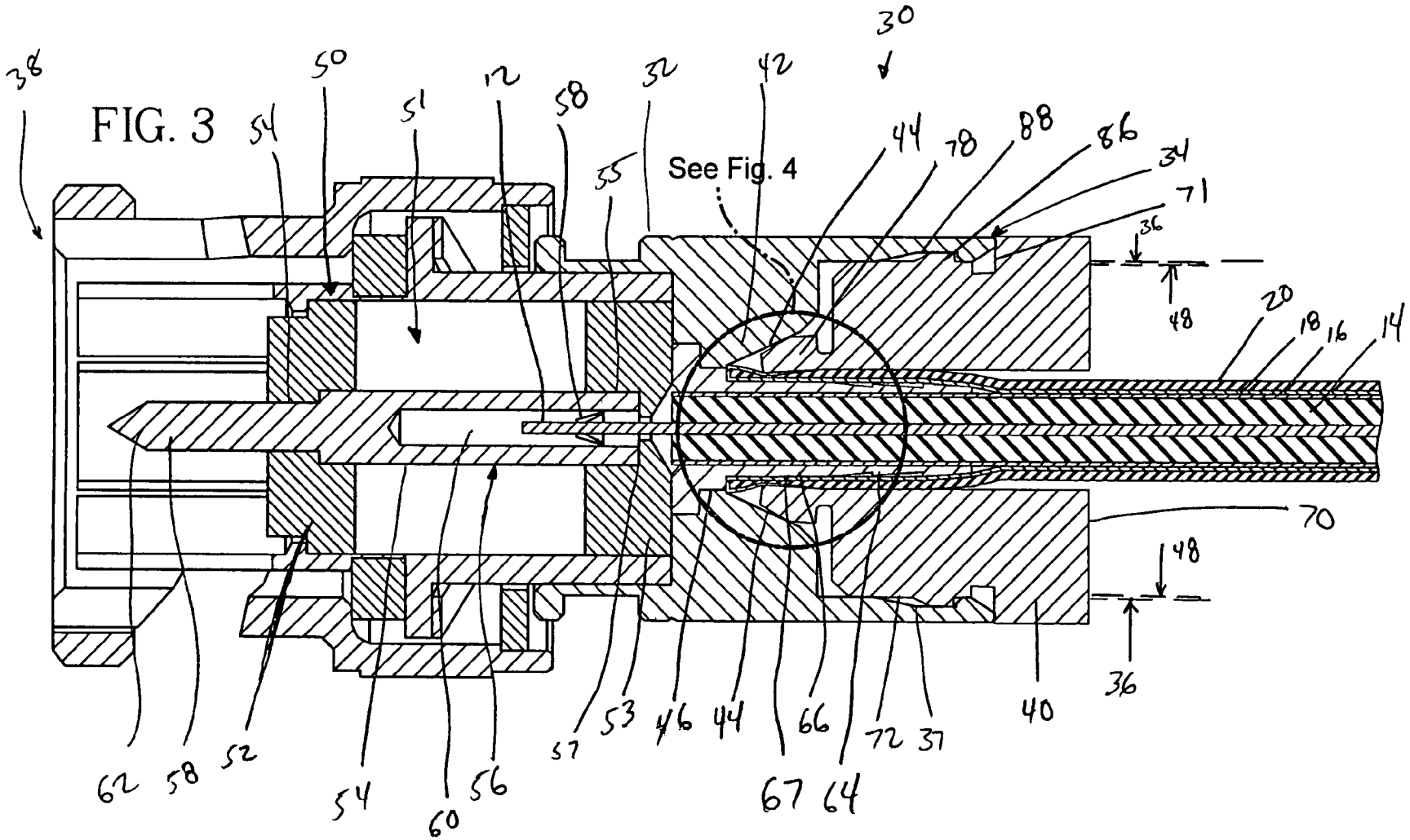
FIG. 3 is a cross-sectional view taken along line 3-3 of the connector shown in FIG. 1.

A typical coaxial shielded cable 10 is shown in FIGS. 1 and 3. The coaxial shielded cable 10 has a center conductor 12 having a dielectric covering 14 surrounding it. The dielectric layer 14 is covered by a foil 16 and a metallic braid 18. The braid 18 is then covered by an outer covering 20 which can be plastic or any other insulating material.

Figure 2:
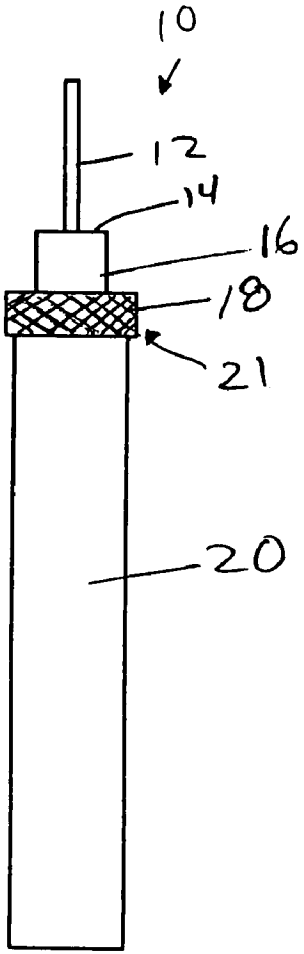
FIG. 2 is a side elevation view of a prepared coaxial shielded cable.

To prepare the coaxial shielded cable 10 for use with the connector 30, the cable is stripped using a wire cutter or similar device. A portion of the center conductor 12 is exposed by removing a portion of the dielectric covering 14. The foil 16 remains covering the dielectric layer 14. The metallic braid 18 is folded back over on the outer covering 20 to form an overlapping portion 21. The overlapping portion 21 extends partially up the length of the outer covering 20. The prepared end 22 of the coaxial shielded cable 10 is shown in FIG. 2 ready to be used with the connector 30.

Referring to FIGS. 1 and 3, the connector 30 will be described in further detail. As discussed above, the connector 30 has a substantially cylindrical housing 32. The housing 32 can be made of a metallic material such as aluminum or copper that can be cast, extruded, or machined. Housing 32 has a first end 34 with an inner diameter 36 sized to receive the outer diameter 48 of the sleeve 40 with minimal amount of excess space. The housing 32 has an opposite second end 38. A ramped wall 42 is provided on an inner surface 37 of the housing 32 between the first end 34 and the second end 38. As will be discussed in further detail below, the wall 42 cooperates with the sleeve 40 to hold the coaxial shielded cable 10 in the connector 30. An opening 46 is positioned in the center of the ramped wall 42. The opening 46 is sized to accept a post 66, as will be discussed in further detail below.

Referring to FIG. 3, the connector 30 further includes a terminal assembly 50 having a terminal 56 positioned centrally and axially in the housing 32. The terminal 56 can be made of an electrically conductive material such as aluminum or copper. The terminal 56 can be held in the housing 32 using a first insulator cap 52 and a second insulator cap 53. The first insulator cap 52 and second insulator cap 53 are preferably disc shaped and sized to fit into the housing 32 through the second end 38. The first insulator cap 52 and second insulator cap 53 are made of an electrically non-conductive material. The first insulator cap 52 and second insulator cap 53 have center apertures 54 and 55, respectively, that are sized to allow a terminal 56 to pass therethrough. The first insulator cap 52 and second insulator cap 53 are held in place in the housing 32 by a friction fit or a contact fit. However, it is envisioned that other types of connecting methods can be used. The first insulator cap 52 and second insulator cap 53 can be spaced apart from each other in the housing 32 to create an air space 51. In an alternative embodiment (not shown), it is contemplated that the first insulator cap 52 and second insulator cap 53 can be constructed to be a single piece.

The terminal 56 has a hollow portion 60 sized to receive the center conductor 12 of the coaxial shielded cable 10. The terminal 56 has a first end 57 which extends toward the first end 34 of the housing 32. The first end 57 forms the opening to the hollow portion 60 of the terminal 56. Positioned within the hollow portion 60 is at least one spring contact 58 made of a resilient metallic material and is positioned to contact the center conductor 12 of the coaxial shielded cable 10. In an alternative embodiment (not shown), the spring contact 58 can be integrally formed with the terminal 56 to create a one piece terminal. The second end 58 of the terminal 56, opposite the first end 57, takes the form of a metal prong 62 extending toward the second end 38 of the connector 30.

Still referring to FIG. 3, the terminal assembly 50 also includes a post 66 adjacent the second insulator cap 53. The post 66 is sized to extend through the opening 46 in the ramped wall 42 toward the first end 34. The post 66 is generally cylindrically shaped with a smooth outer surface 67 and is held in place between the insulator 52 and the rear wall 42. The post is made of a metallic material such as aluminum or copper. The post 66 is positioned centrally in the first end 34 so it is positioned between the foil 16 and the braid 18 when the coaxial shielded cable 10 is inserted into the connector 30. The smooth outer surface 67 of the post 66 allows for the coaxial shielded cable 10 to be inserted into the connector 30 with minimal force reducing the chance of buckling. The smooth outer surface 67 of the post 66 also allows for easier manufacture of the connector. As will be discussed in further detail below, the post 66 preferably has a plurality of raised barbs 64 on its outer surface 67 used to grip the braid 18 when the coaxial shielded cable 10 is pressed against the post 66.

Figure 6:
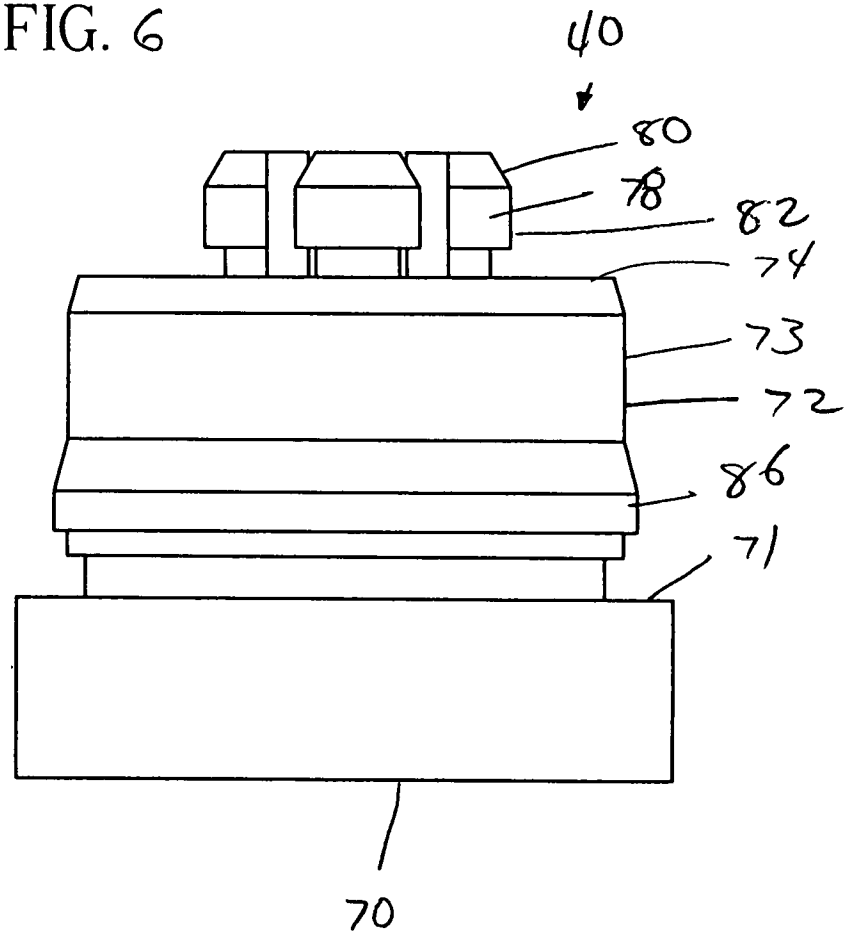
FIG. 6 is a side elevational view of the sleeve shown in FIG. 5.
Figure 5:
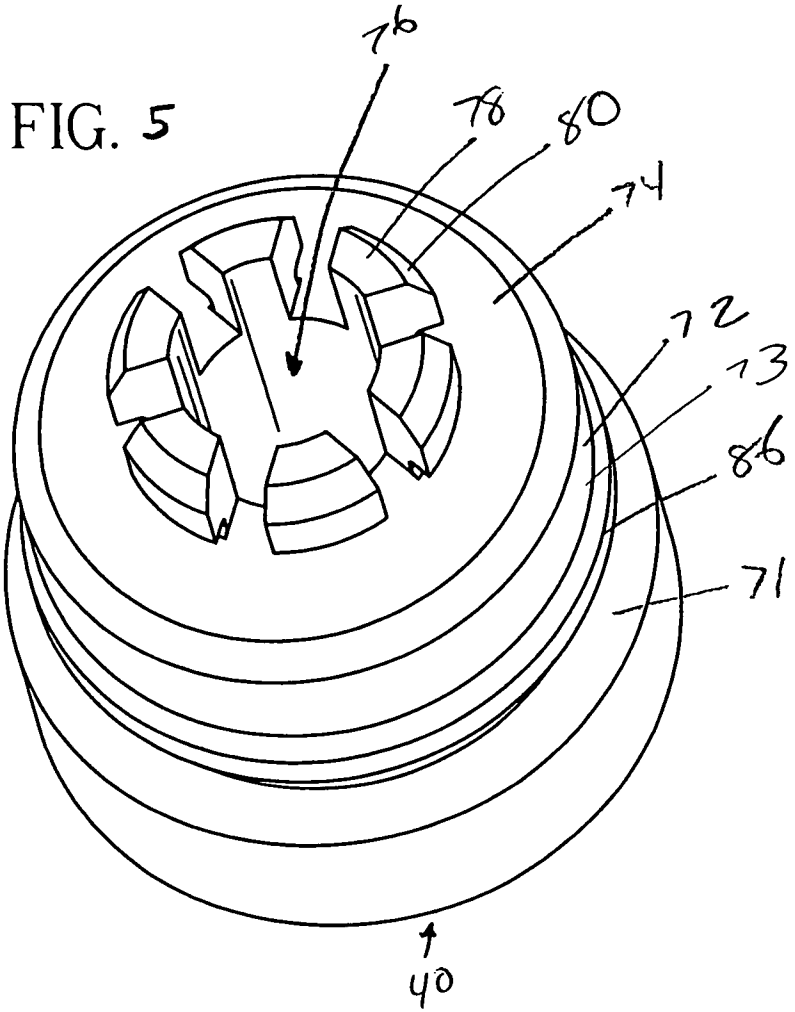
FIG. 5 is a top perspective view of the sleeve of the present invention.

Referring additionally to FIGS. 5 and 6, movably received in the first end 34 of the housing 32 is a locking sleeve 40 that securely holds the coaxial shielded cable 10 in the connector 30. Sleeve 40 can be cylindrically shaped having a base 70 with upwardly extending sidewalls 72. The sidewalls 72 terminate at an upper portion 74 which is substantially parallel to the base 70. A sleeve aperture 76 extends from the base 70 to the upper portion 74 through the sleeve 40. The sleeve aperture 76 is sized to allow the coaxial shielded cable 10 to pass through the sleeve 40 with minimal play.

A plurality of resilient tabs or fingers 78 are positioned around the opening of the sleeve aperture 76 on the upper portion 74 of the sleeve 40. The resilient tabs 78 have beveled or angled end portions 80 (FIG. 6), which are positioned on the sleeve 40 so that when the sleeve is inserted into the first end 34 of the housing 32, the ramped wall 42 formed on the inner surface 37 of the housing 32 will contact the angled portions 80 of the resilient tabs 78 to push them towards the center of the sleeve aperture 76.

The sleeve 40 can also have an annular rim 86 on the outer surface 73 of the sidewall 72. The housing 32 can have on its inner surface 37 a corresponding groove 88 which accepts the annular rim 86 to create a cooperating detent locking structure between the sleeve 40 and the housing. Preferably, the outer diameter of the sleeve 48 is sized smaller than the inner diameter 36 of the first end 34 to allow the sleeve 40 to be inserted into the first end 34.

In order to use the present invention, the user first prepares the coaxial shielded cable 10 as shown in FIG. 2. The user then inserts the coaxial shielded cable 10 through the sleeve aperture 76 of the sleeve 40 so that the overlapping portion 21 of the coaxial shielded cable 10 extends beyond the resilient tabs 78. The user then pushes the coaxial shielded cable 10 and the upper portion 74 of the sleeve 40 into the first end 34 of the connector 30. As the user pushes the coaxial shielded cable 10 into the connector 30, the terminal 56 and the spring contacts 58 receive the center conductor 12. At the same time, the post 66 is forced between the braid 18 and foil 16 establishing electrical and mechanical engagement with the coaxial shielded cable 10.

Figure 4:
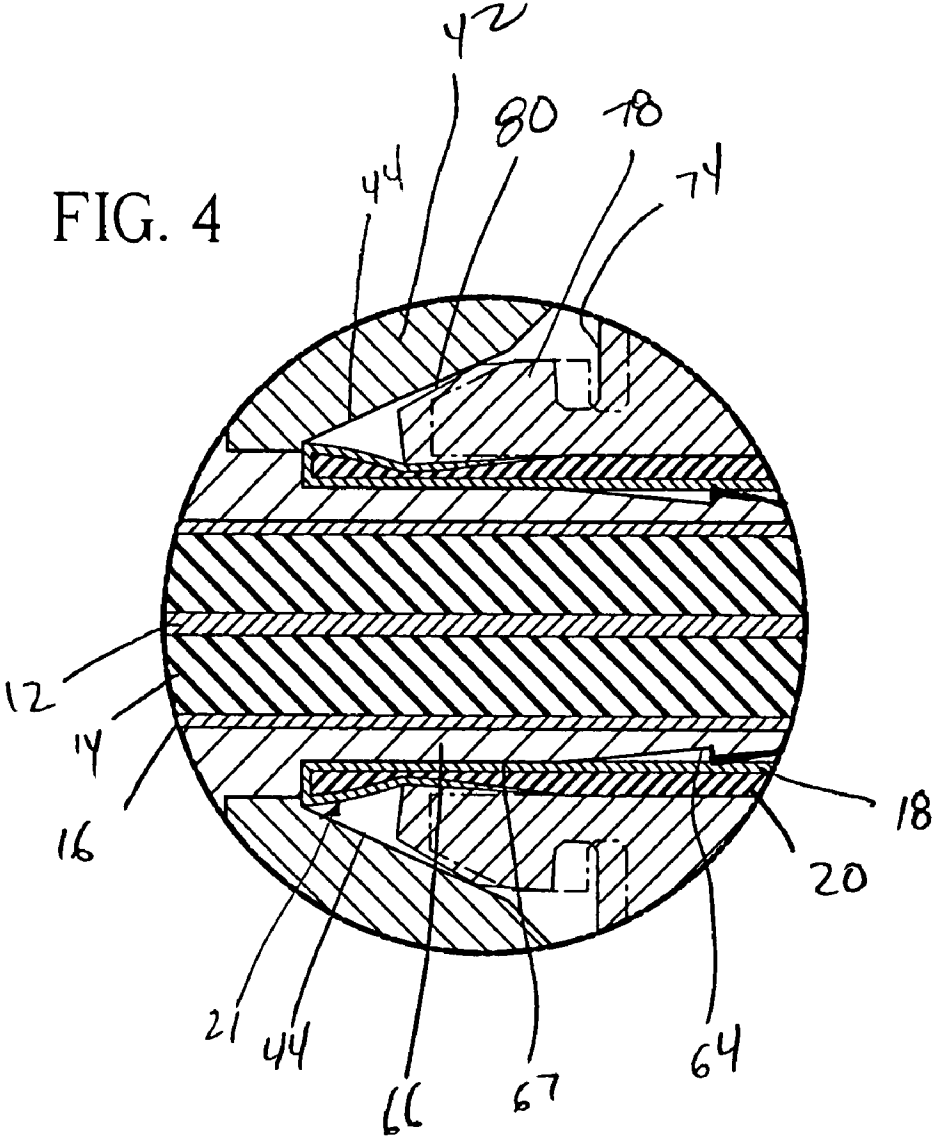
FIG. 4 is a detailed view of the cable gripping feature of the sleeve of the present invention with the sleeve fully inserted into the connector body.

Referring to FIG. 4, after the coaxial shielded cable 10 is fully inserted into the housing 32 so that the post 66 is inserted between the braid 18 and foil 16, the sleeve 40 is pushed into the housing 32 so that the resilient tabs 78 will touch a contact portion 44 of the ramped wall 42. The resilient tabs 78 are shown in phantom before touching the contact portion 44. The contact portion 44 of the wall 42 and the angled portions 80 of the resilient tabs 78 interact with each other to deflect the resilient tabs 78 towards the center of the sleeve aperture 76. As the resilient tabs 78 are biased, they are pressed into the outer covering 20 to firmly hold the coaxial shielded cable 10 in place as shown in FIG. 4. Preferably, the contact portion 44 has a cone shape sized smaller than the resilient tabs 78 extending from the sleeve 40.

The user continues to insert the sleeve 40 into the first end 34 until the annular rim 86 becomes engaged with the corresponding groove 88 in the inner surface 37 of the first end 34 to hold the sleeve 40 in place. At the same time, an upper ledge 71 of the base 70 can contact the first end 34 to indicate to the user that the sleeve 40 is fully inserted into the first end 34. The tension created between the resilient tabs 78 and the post 66, along with the additional gripping force provided by the barbs 64, prevent the coaxial shielded cable 10 from being inadvertently removed from the connector 30.

Figure 7:
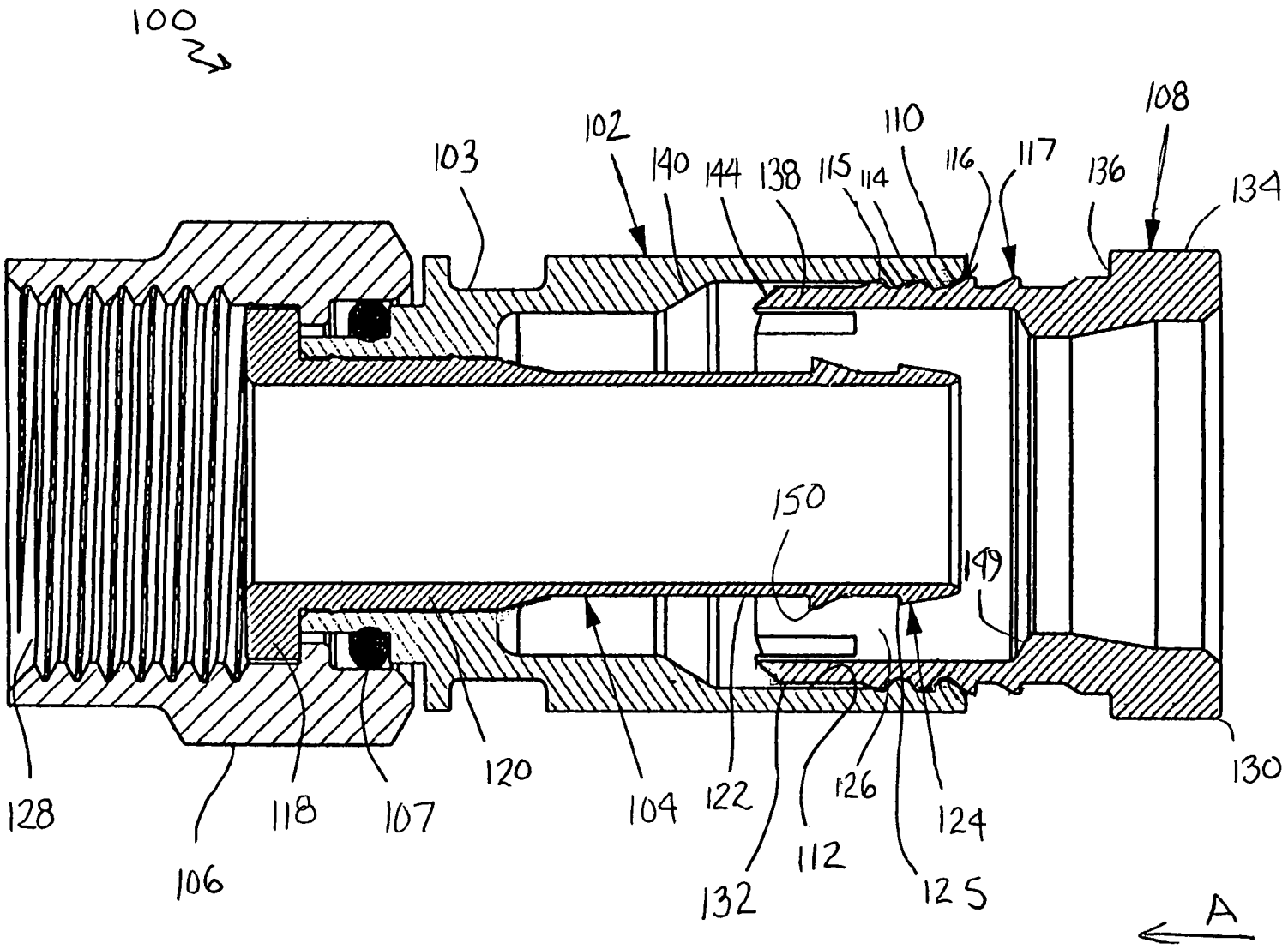
FIG. 7 is a cross-sectional view of an alternative embodiment of the coaxial connector of the present invention.
Figure 8:
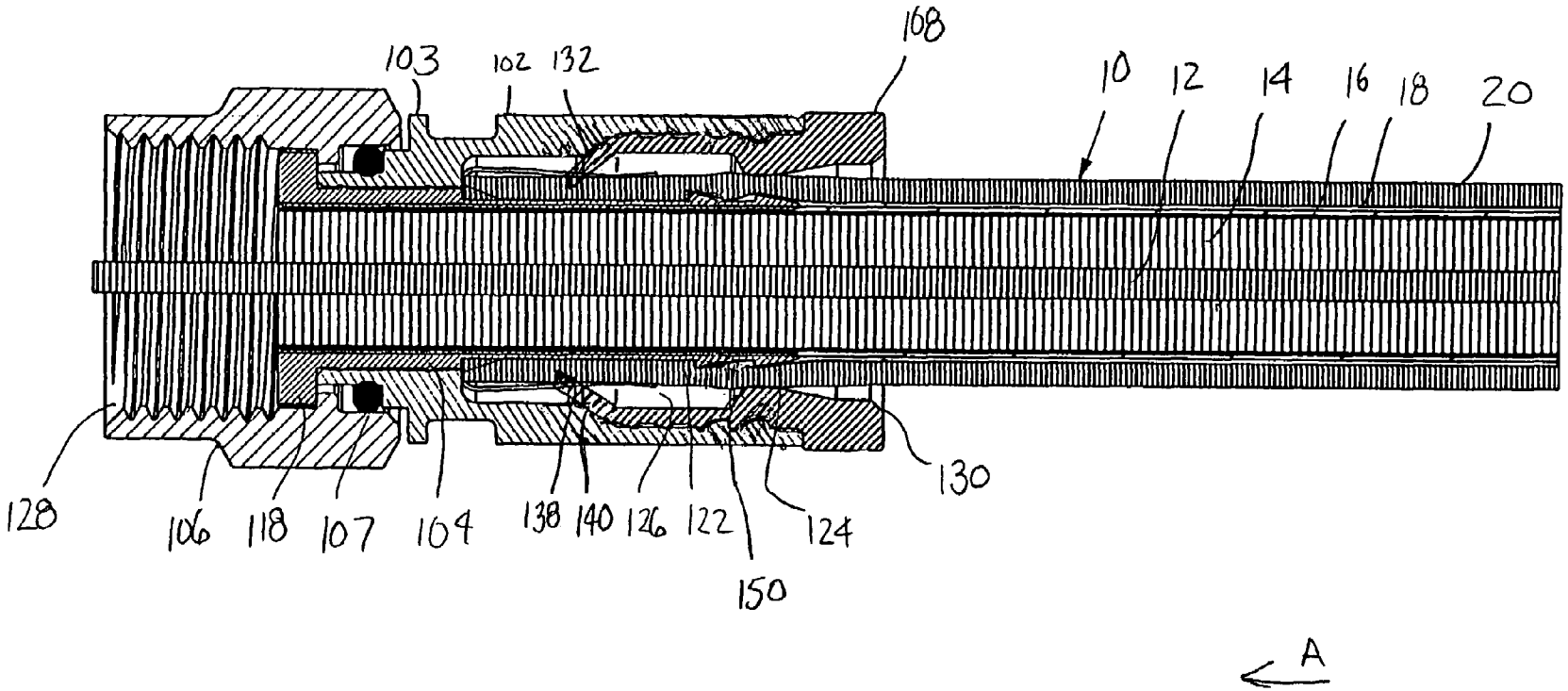
FIG. 8 is cross-sectional view of the connector shown in FIG. 7 in a closed position with a cable secured thereto.

Referring now to FIGS. 7 and 8, an alternative embodiment of the coaxial cable connector according to the present invention is shown. The type of connector 100 shown in FIGS. 7 and 8 is known in the industry as a compression connector. It generally includes four components: a connector body 102; an annular post 104; a rotatable nut 106; and a movable locking sleeve 108. It is however conceivable that the connector body 102 and the post 104 can be integrated into one component and/or another fastening device other than the rotatable nut 106 can be utilized. Also, a resilient sealing O-ring 107 may be positioned between the body 102, the post 104 and the nut 106 at the rotatable juncture thereof to provide a water resistant seal thereat.

The connector body 102 is an elongate generally cylindrical member, which is preferably made from plastic to minimize cost. Alternatively, the body 102 may be made from metal or the like. The body 102 has one end 103 coupled to the post 104 and the nut 106 and an opposite sleeve receiving end 110 for insertably receiving the sleeve 108. The sleeve receiving end 110 defines an inner engagement surface 112 having one or more grooves 114 and/or projections 115, which engage cooperating grooves 116 and/or projections 117 formed on the outer surface of the sleeve 108 for locking the sleeve in the body 108.

The annular post 104 includes a flanged base portion 118, which is rotatably seated in a post receiving space in the nut 106, and a widened shoulder portion 120, which provides for press-fit securement of the post within the collar 102. The annular post 104 further includes an annular tubular extension 122 extending rearward within the body 102 and into the sleeve 108. As mentioned above, the rearward end of the tubular extension 122 preferably includes a radially outwardly extending ramped flange portion or "barb" 124 having a forward facing edge 125 for compressing the outer jacket of the coaxial cable against the internal diameter of the body to secure the cable within the connector. Alternatively, and/or depending on the method of forming the post 104, the barb 124 may be more rounded as opposed to having a sharp edge 125. In any event, as will be described in further detail hereinbelow, the extension 122 of the post 104, the body 102 and the sleeve 108 define an annular chamber 126 for accommodating the jacket and shield of the inserted coaxial cable.

The nut 106 may be in any form, such as a hex nut, knurled nut, wing nut, or any other known attaching means, and is rotatably coupled to the post 104 for providing mechanical attachment of the connector 100 to an external device. The nut 106 includes an internally threaded end extent 128 permitting screw threaded attachment of the connector 100 to the external device. The sleeve 108 and the internally threaded end extension 128 define opposite ends of the connector 100.

The locking sleeve 108 is a generally tubular member having a rearward cable receiving end 130 and an opposite forward connector insertion end 132, which is movably coupled to the inner surface 112 of the connector body 102 to allow for axial movement of the sleeve 108 within the connector body 102 along arrow A of FIGS. 7 and 8 toward the nut 106 from a first position shown in FIG. 7, which loosely retains a cable 10 within the connector 100, to a more forward second position shown in FIG. 8, which secures the cable within the connector.

The locking sleeve 18 further preferably includes a flanged head portion 134 disposed at the rearward cable receiving end 130 thereof. The head portion 134 has an outer diameter larger than the inner diameter of the body 102 and includes a forward facing perpendicular wall 136, which serves as an abutment surface against which the rearward end of the body 102 stops to prevent further insertion of the sleeve 108 into the body 102.

The forward end 132 of the sleeve 108 is further formed with a plurality of flexible fingers 138 extending in the forward direction. These fingers 138 are forced to deflect radially inwardly by an internal ramp portion 140 formed on the inner engagement surface 112 of the connector body 102 during insertion of the sleeve 108 into the body. As the fingers 138 are deflected inward, they engage the outer jacket of the cable 10 to enhance the gripping of the cable within the connector 100.

Figure 9:
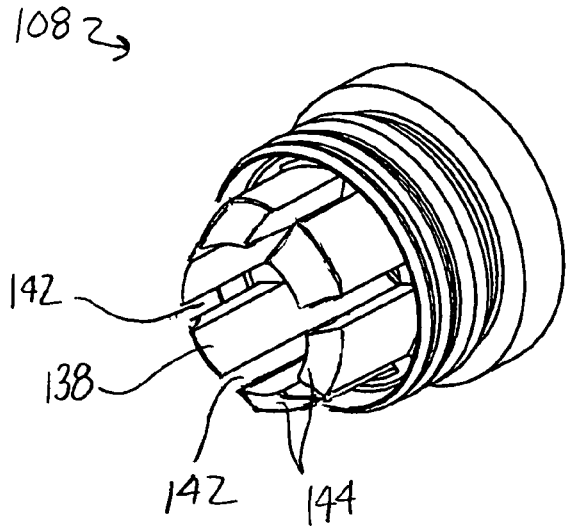
FIG. 9 is a perspective view of an alternative embodiment of the sleeve.

Referring additionally to FIG. 9, the fingers 138 may be formed by providing longitudinal slots 142 at the forward end of the sleeve 108. Furthermore, the fingers 138 may include a tapered end 144 so as to form a relatively sharp edge. The sharp edge 144 would tend to bite into the cable 10 upon deflection of the fingers 138 by the internal ramp portion 140 of the connector body 102 to provide even greater gripping force and prevent the cable from being pulled out of the connector.

Figure 10:
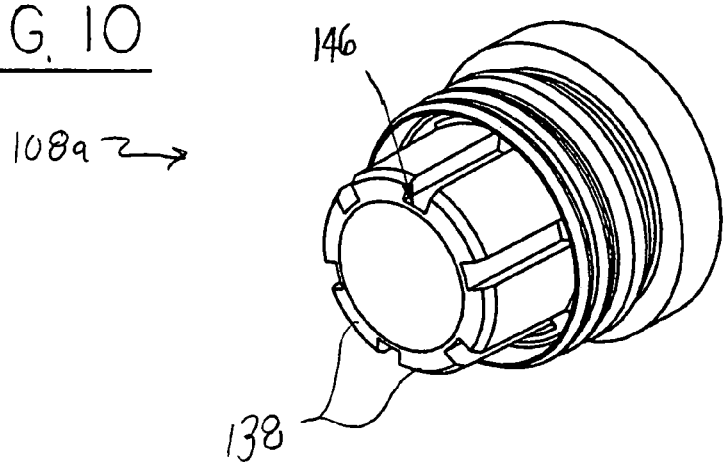
FIG. 10 is a perspective view of an alternative embodiment of the sleeve.
Figure 11:
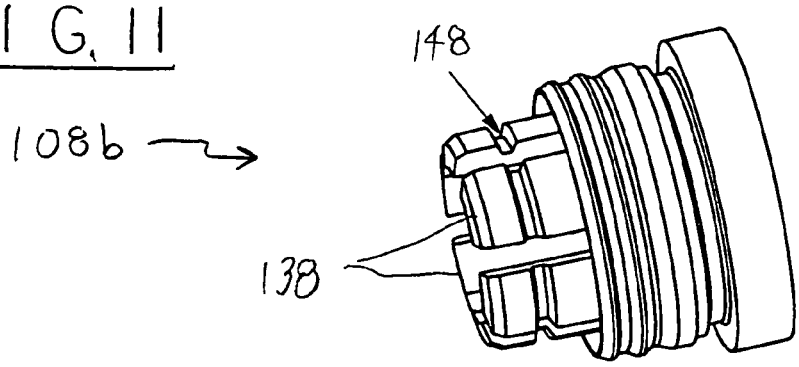
FIG. 11 is a perspective view of another alternative embodiment of the sleeve.

Alternatively, as shown in FIG. 10, the fingers 138 may be formed integral with each other, wherein a web 146 connects adjacent fingers. The web 146 can be located anywhere between the inner and outer diameter of the gripping fingers 138. In another alternative embodiment, as shown in FIG. 11, a lateral groove 148 can be formed in the fingers 138 to increase the flexibility of the fingers.

In use, the cable 10 is prepared as described above by stripping back the jacket 20 exposing an extent of shield 18. A portion of the foil covered insulator 14 extends therefrom with an extent of conductor 12 extending from the insulator. After an end extent of shield 18 is folded back about jacket 20, the cable 10 may be inserted into the connector 100 with the sleeve 108 already coupled to the body 102, as shown in FIG. 7. In this technique, the prepared cable 10 is inserted through the rearward end 130 of the sleeve 108 and the extension 122 of the post 104 is inserted between the foil covered insulator 14 and the metallic shield 18 such that the shield and the jacket 20 reside within the annular region 126 defined between the post 104 and the sleeve 108. When the sleeve 108 is coupled to the body 102 in the first position, as shown in FIG. 7, sufficient clearance is provided between the sleeve and the post 104 so that the tubular post extension 122 may be easily interposed between the insulator 14 and the shield 18 of the cable 10.

Once the cable 10 is properly inserted, the sleeve 108 may be moved axially forward in the direction of arrow A from the first position shown in FIG. 7, to the second position shown in FIG. 8. The sleeve 108 is moved axially forward until the forward facing abutment surface 136 of the sleeve head portion 134 engages the rearward end of the body 102. A suitable compression tool may be used to effect movement of the sleeve 108 from its first position to its second position securing the cable 10 to the connector 100.

As the sleeve 108 moves to this second position, the jacket 20 and shield 18 of the cable 10 begin to become compressively clamped within the annular region 126 between the barb 124 of the post 104 and the inner surface of the sleeve 180. In this regard, the inner surface of the sleeve 18 is preferably provided with an inwardly directed shoulder portion 149 to facilitate compression of the cable jacket 20 against the barb 124 of the post 104. Also, as the sleeve 108 moves to its second position, the sleeve fingers 138 are urged inwardly by the ramp 140 formed in the connector body 102 to further engage the cable jacket 20.

To further enhance locking of the cable 10, the post 104 of the present invention is preferably provided with a second annular cable retention barb 150 disposed forward of the rearward end barb 124. Both the rearward end barb 124 and the forward barb 150 are annular protrusions extending radially outwardly from the outer diameter of the tubular extension 122. In other words, like the first barb 28, the second barb 74 is generally an annular, radially outwardly extending, ramped flange portion of the post 104 having a forward facing edge for compressing the outer jacket of the coaxial cable to secure the cable within the connector 100. The second barb 150 improves both the mechanical retention of the cable as well as the electromagnetic isolation or shielding of the signal inside the connector.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

a connector body having a rearward sleeve receiving end and an inner engagement surface;

an axially movable locking sleeve seated in said rearward sleeve receiving end of said connector body, said locking sleeve having a rearward cable receiving end and an opposite forward connector insertion end, said forward connector insertion end being formed with at least one flexible finger for gripping a cable inserted in said sleeve when said locking sleeve is moved from a first position to a second position; and an annular post disposed within said connector body, said post having a shoulder portion in press-fit engagement with said connector body, a first radially outwardly projecting barb disposed at a rearward end thereof, a second radially outwardly projecting barb disposed forward of said first barb and an annular tubular extension extending between said shoulder portion and said first and second barbs and having a maximum outer diameter, said first and second barbs having an outer diameter greater than the maximum outer diameter of said annular tubular extension.

2. A coaxial cable connector as defined in claim 1, wherein said connector body includes an internal ramp portion formed on said inner engagement surface for deflecting said flexible finger radially inward as said locking sleeve is moved from said first position to said second position.

3. A coaxial cable connector as defined in claim 1, further comprising a twistlock device rotatably coupled to said connector body.

4. A coaxial cable connector as defined in claim 1, wherein said sleeve is made from a plastic material.

5. A coaxial cable connector as defined in claim 1, wherein said connector body is made from a plastic material.

6. A coaxial cable connector as defined in claim 1, wherein said flexible finger includes a tapered forward end defining a sharp edge to facilitate gripping of the cable.

7. A coaxial cable connector as defined in claim 1, wherein said locking sleeve includes an outer connector body engagement surface cooperating with said inner engagement surface of said connector body to permit said axial movement of said sleeve from said first position, wherein a cable is loosely retained in the connector, to said second position, wherein a cable is secured in the connector.

8. A coaxial cable connector comprising:

a connector body having a rearward sleeve receiving end and an inner engagement surface; and an axially movable locking sleeve seated in said rearward sleeve receiving end of said connector body, said locking sleeve having a rearward cable receiving end and an opposite forward connector insertion end, said forward connector insertion end being formed with at least one flexible finger for gripping a cable inserted in said sleeve when said locking sleeve is moved from a first position to a second position, wherein said locking sleeve includes a plurality of flexible fingers defining said forward connector insertion end of said sleeve, at least two adjacent fingers being connected by a web.

9. A coaxial cable connector comprising:

a connector body having a rearward sleeve receiving end and an inner engagement surface; and an axially movable locking sleeve seated in said rearward sleeve receiving end of said connector body, said locking sleeve having a rearward cable receiving end and an opposite forward connector insertion end, said forward connector insertion end being formed with at least one flexible finger for gripping a cable inserted in said sleeve when said locking sleeve is moved from a first position to a second position, wherein said flexible finger includes a lateral groove formed therein to enhance flexibility of said finger.

10. A coaxial cable connector as defined in claim 1, wherein said locking sleeve comprises:

a base having a forward facing abutment surface;

an upper portion having a forward facing surface substantially parallel with said forward facing abutment surface of said base, said flexible finger extending in a forward direction from said forward facing surface of said upper portion; and a sidewall extending in a forward direction from said forward facing abutment surface and terminating at said upper portion.

11. A coaxial cable connector as defined in claim 10, wherein said locking sleeve further comprises a plurality of said flexible fingers arranged in a ring, said ring having an outer diameter less than an outer diameter of said sidewall.

12. A coaxial cable connector as defined in claim 10, wherein said locking sleeve further comprises a lateral groove formed between said forward facing surface of said upper portion and said flexible finger to enhance flexibility of said finger.

13. A coaxial cable connector as defined in claim 1, wherein said first and second barbs define an annular region therebetween, and wherein said locking sleeve further comprises an inner surface and an inwardly directed shoulder portion provided on said inner surface, said inwardly directed shoulder portion being disposed in said annular region between said first and second barbs when said locking sleeve is in said second position for facilitating compression of the cable.

* * * * *